US006161613A

United States Patent [19]

Huenniger

[11] Patent Number: 6,161,613

[45] Date of Patent: Dec. 19, 2000

[54] LOW PRESSURE DROP HEAT EXCHANGER

[75] Inventor: Edward A. Huenniger, Liverpool, N.Y.

[73] Assignee: Carrier Corporation, Syracuse, N.Y.

[21] Appl. No.: 08/754,371

[22] Filed: Nov. 21, 1996

[51] Int. Cl.[7] ..... F28F 9/22

[52] U.S. Cl. ..... 165/145; 165/139; 165/158; 62/325

[58] Field of Search ..... 165/158, 139, 165/137, 146, 110

[56] References Cited

U.S. PATENT DOCUMENTS

| | | | |
|---|---|---|---|
| 267,797 | 11/1882 | Miles | 165/158 |
| 1,725,322 | 8/1929 | Vezi | 165/158 |
| 2,382,900 | 8/1945 | Newcomb | 165/158 X |
| 2,870,997 | 1/1959 | Söderstrom | 165/158 |
| 3,568,764 | 3/1971 | Newman | 165/158 |
| 3,760,870 | 9/1973 | Guetlhuler | 165/158 X |
| 3,802,498 | 4/1974 | Romanos | 165/158 |
| 3,923,466 | 12/1975 | Seelig et al. | 165/139 X |
| 4,190,101 | 2/1980 | Hartmann | 165/158 |
| 4,289,196 | 9/1981 | Jabsen et al. . | |
| 4,474,011 | 10/1984 | Nelson et al. | 165/158 X |
| 4,993,485 | 2/1991 | Gorman | 165/158 X |
| 5,107,721 | 4/1992 | Tsai | 165/137 X |

*Primary Examiner*—Christopher Atkinson

[57] ABSTRACT

A two pass heat exchanger is provided. The first pass includes a plurality of tubes located in liquid refrigerant, when employed as an evaporator, whereby the liquid refrigerant draws heat from the water flowing through the tubes causing the water to be cooled and the liquid refrigerant to evaporate. The second pass is a single pipe which need not be located in the liquid refrigerant. The two pass heat exchanger can also be used as a condenser.

6 Claims, 1 Drawing Sheet

LOW PRESSURE DROP HEAT EXCHANGER

BACKGROUND OF THE INVENTION

Shell and tube heat exchangers, of the kind where water flows through a plurality of tubes in heat transfer relationship with a refrigerant on the shell side, are often used as evaporators and condensers, along with at least one compressor and other components to create an assembled water chilling unit. As an assembly, the changing of one component often has an impact on the other structure. For example, the evaporator may serve as the support for the compressor or condenser.

Another general constraint in chiller design is to have an even number of passes on the waterside so that all of the water connections can be located at one end of the heat exchanger shell, thus permitting the cleaning or servicing of the tubes from the other end without disturbing the water connections.

There are occasions where it is desired to reduce heat exchanger size to meet a given set of thermal and pressure drop requirements, yet such a reduction of the exchanger shell may not be possible due to the interrelationship of the various components of the chiller. For example, to match desired performance characteristics, it may be desirable to use a short length condenser shell with in combination with a long length cooler shell, but the chiller assembly would be compromised as a result.

SUMMARY OF THE INVENTION

The reduced heat exchange requirement for a heat exchanger is addressed by providing a two pass design with essentially all of the required heat transfer taking place in one pass. The one pass employs tubes having the desired diameters and surface characteristics for the desired heat transfer and pressure drop while the second or return pass employs a single large diameter tube or pipe. Specifically, the second pass of a two pass shell and tube heat exchanger has the normal compliment of tubes replaced with a return pipe. This allows a drastic reduction in the total number of heat exchanger tubes, when very high heat transfer performance is not a requirement, without the usual accompanying increase in water side pressure drop. Additionally, this configuration allows the maintenance of relatively high water side velocities in the tubes of the first pass for the effective use of the heat transfer surface. In an evaporator, because the second pass would have only nominal heat transfer due to its limited heat transfer surface area, the second pass need not be located within the liquid refrigerant which permits the lowering of the refrigerant level and thereby the refrigerant charge in the system.

It is an object of this invention to permit the removal of substantial members of heat exchanger tubes without sacrificing waterside pressure drop and pumping power.

It is another object of this invention to make cost effective use of enhanced heat transfer tubing by keeping waterside velocities relatively high without the usual increase in overall heat exchanger waterside pressure drop.

It is a further object of this invention to allow for the optimization of heat exchangers for use in water chiller units without compromising the design of the other chiller components.

It is another object of this invention to reduce the refrigerant charge in a refrigeration system. These objects, and others as will become apparent hereinafter, are accomplished by the present invention.

Basically, a two pass heat exchanger becomes the equivalent of a one pass heat exchanger by having the second pass be a single pipe serving primarily as a return flow. The heat exchanger may be used as either an evaporator or a condenser.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
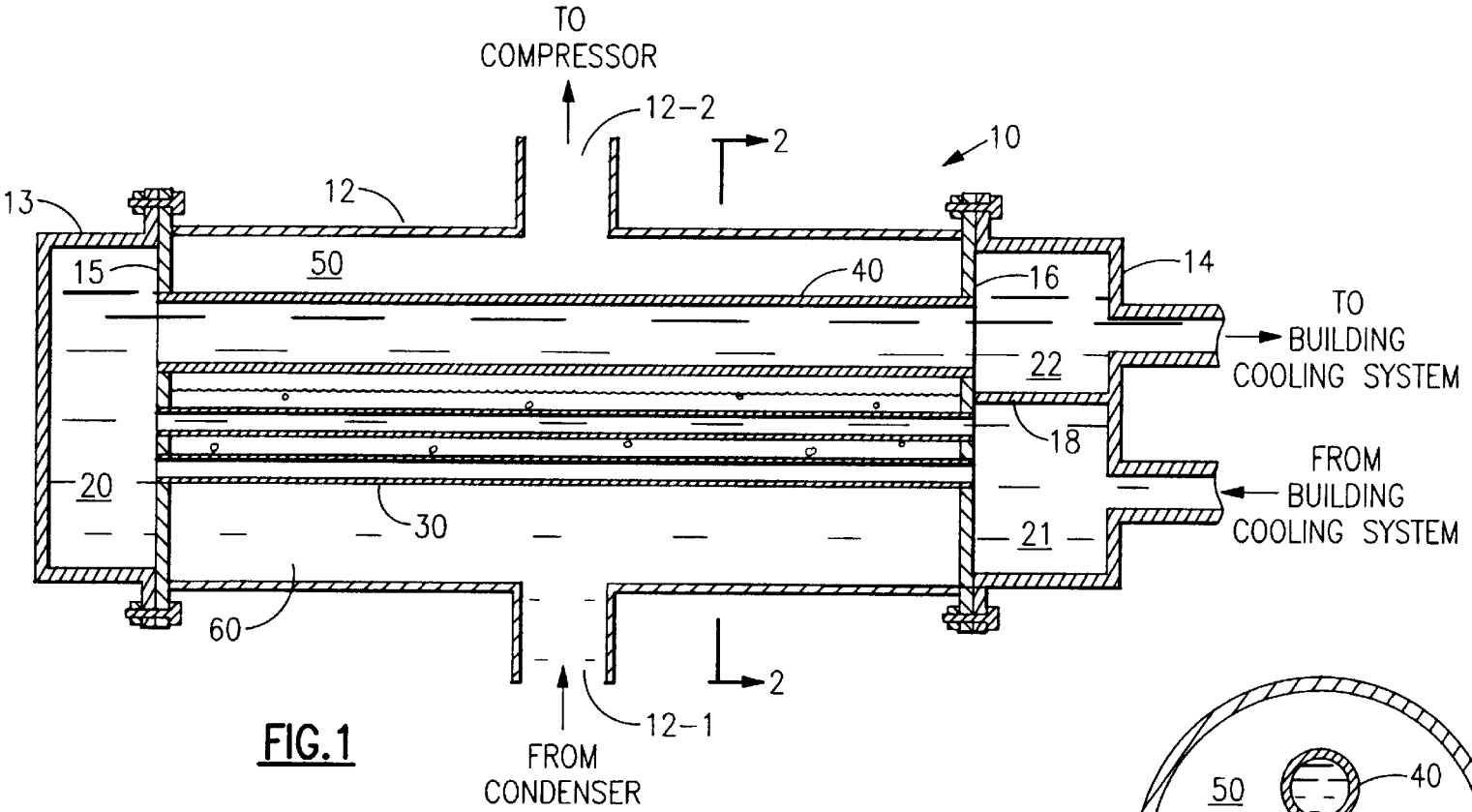
FIG. 1 is a sectional view of a heat exchanger employing the present invention.
Figure 2:
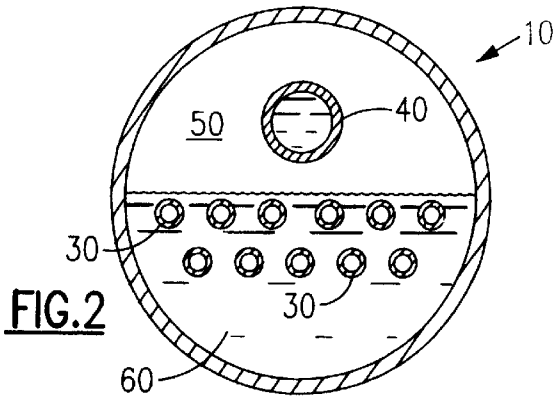
FIG. 2 is a sectional view taken along line 2—2 of FIG. 1.

In the Figures, the numeral 10 generally designates a two pass shell and tube heat exchanger which is illustrated as a evaporator, but a condenser would only differ in its fluid connections, not in its structure. Heat exchanger 10 has a generally cylindrical shell 12 with end pieces 13 and 14, respectively. End piece 13 coacts with tube sheet 15 to define intermediate water box 20. End piece 14 coacts with tube sheet 16 and divider plate 18 to define inlet water box 21 and outlet water box 22, respectively. Heat exchanger 10 has a first pass heat exchanger extending from inlet water box 21 to water box 20 and includes a plurality of small diameter heat transfer tubes 30. Typically, the tubes 30 are internally and/or externally enhanced to promote heat exchange. The second pass heat exchanger of heat exchanger 10 is a large diameter pipe or tube 40 extending from intermediate water box 20 to outlet water box 22.

Tubes 30 and pipe 40 are located in a generally cylindrical chamber 50 defined by shell 12 and tube sheets 15 and 16. Chamber 50 receives liquid refrigerant 60 from the condenser (not illustrated) via inlet 12-1 when operated as an evaporator, as illustrated. Because pipe 40 is generally not relied on for providing heat transfer, the level of the liquid refrigerant 60 need only be above tubes 30, and need not cover pipe 40. The heat transfer area of pipe 40, as compared to the total of tubes 30 will be small. When operated as a condenser, 12-2 is an inlet receiving gaseous refrigerant. The gaseous refrigerant condenses due to heat transfer to the water in tubes 30 and condensed, liquid refrigerant is drawn off through 12-1 which functions as an outlet.

In operation as an evaporator, liquid refrigerant 60 is supplied from the condenser (not illustrated) via inlet 12-1 to chamber 50 where it extracts heat from and thereby cools the water passing through tubes 30 while the liquid refrigerant 60 evaporates. The gaseous refrigerant passes from chamber 50 via outlet 12-2 to the suction of the compressor (not illustrated). Water from the closed loop cooling circuit of the refrigeration system (not illustrated) is supplied from the building cooling system to inlet water box 21. The water then passes through tubes 30 in heat exchange relationship with the liquid refrigerant 60. The liquid refrigerant draws heat from and thereby cooling the water while the liquid refrigerant 60 is evaporated. The heat transfer takes place in the first pass defined by tubes 30 with only a small amount of heat transfer being available through pipe 40, Whether or not pipe 40 is located in liquid refrigerant 60. The water passing through the second pass defined by pipe 40 enters outlet water box 22 from which it flows into the closed circuit building cooling system to provide cooling.

When operated as a condenser, gaseous refrigerant is supplied to chamber 50 where it is cooled and condensed due to heat transfer to the water flowing through tubes 30, and to a lesser extend to the water flowing through pipe 40. The condensed, liquid refrigerant collects at the bottom of chamber 50, normally below the level of tubes 30. The liquid refrigerant is drawn off and supplied to the evaporator (not illustrated).

Although a preferred embodiment of the present invention has been illustrated and described, other changes will occur to those skilled in the art. It is therefore intended that the scope of the present invention is to be limited only by the scope of the appended claims.

What is claimed is:

1. A heat exchanger comprising:

a shell and a pair of end pieces sealed to said shell;

a first tube sheet coacting with a first one of said pair of end pieces to define an intermediate water box;

a second tube sheet coacting with a second one of said pair of end pieces and a divider plate to define an inlet water box and an outlet water box;

said first and second tube sheets coacting with said shell to define a chamber;

a first pass including a plurality of heat transfer tubes extending from said inlet water box through said chamber to said intermediate water box;

a second pass defined by a single, large diameter pipe extending from said intermediate water box through said chamber to said outlet water box whereby a water circuit is serially defined by said inlet water box, said first pass, said intermediate water box, said second pass and said outlet water box.

2. The heat exchanger of claim 1 wherein:

liquid refrigerant is located in said chamber and said first pass is in said liquid refrigerant.

3. The heat exchanger of claim 2 wherein said second pass is located above said liquid refrigerant.

4. The heat exchanger of claim 1 wherein:

said shell is of a generally cylindrical shape and is horizontally oriented;

a first port is located at the bottom of said shell and is in fluid communication with said chamber; and a second port is located at the top of said shell and is in fluid communication with said chamber.

5. The heat exchanger of claim 4 wherein said first port is a liquid inlet and said heat exchanger is an evaporator.

6. The heat exchanger of claim 4 wherein said second port is a liquid outlet and said heat exchanger is a condenser.

* * * * *